US005115530A

United States Patent [19]

Distiso

[11] Patent Number: 5,115,530

[45] Date of Patent: May 26, 1992

[54] ROTARY TOOTHBRUSH

[76] Inventor: Robert G. Distiso, 74 Sheffield St., Waterbury, Conn. 06704

[21] Appl. No.: 535,391

[22] Filed: Jun. 8, 1990

[51] Int. Cl.[5] ..... A46B 13/08

[52] U.S. Cl. ..... 15/25; 15/26; 15/143 R; 15/145; 16/110 R; 16/114 R; 81/489; 206/362.2

[58] Field of Search ..... 15/25, 26, 143 R, 145, 15/23, 24; 16/110 R, 110 A, 110.5, 114 R, 114 A, DIG. 12, DIG. 18, DIG. 19; 81/489; 30/332; 206/362.1, 471

[56] References Cited

U.S. PATENT DOCUMENTS

| | | | |
|---|---|---|---|
| 1,197,419 | 9/1916 | Wilming et al. | 15/25 |
| 1,425,435 | 8/1922 | Allen | 15/25 |
| 2,059,330 | 11/1936 | Flournoy | 15/25 |
| 2,228,786 | 1/1941 | Stoner | 15/25 |
| 2,874,836 | 2/1959 | Wertepny, Jr. | 206/471 |
| 4,841,638 | 6/1989 | Bardeen et al. | 30/332 |

FOREIGN PATENT DOCUMENTS

| | | | |
|---|---|---|---|
| 8906919 | 8/1989 | World Int. Prop. O. | 15/145 |

*Primary Examiner*—Edward L. Roberts
*Attorney, Agent, or Firm*—Michael I. Kroll

[57] ABSTRACT

An axis rotary toothbrush is provided and consists of an elongated shaft having a distal portion rotatably positioned within a handle so that a proximal portion of the shaft will extend outwardly therefrom. A bristle head is formed about the free end of the proximal portion of the shaft while a ferrule is affixed onto the proximal portion of the shaft adjacent the handle. The index finger and thumb of a hand gripping the handle can manually rotate the ferrule to turn the shaft and the bristle head in a clockwise and counterclockwise direction about the axis of the shaft in order for the bristle head to brush the teeth.

9 Claims, 2 Drawing Sheets

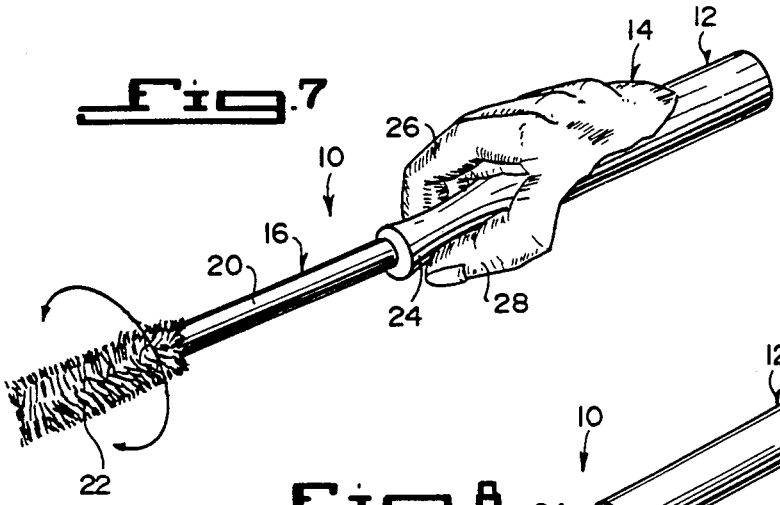
Fig. 7
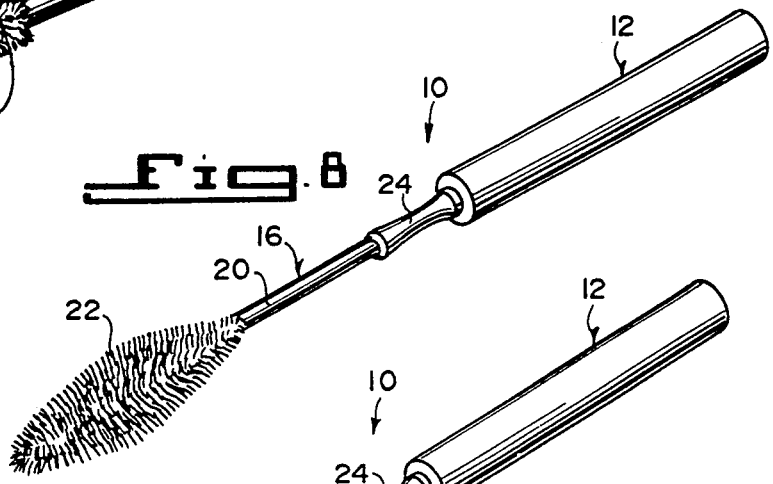
Fig. 8
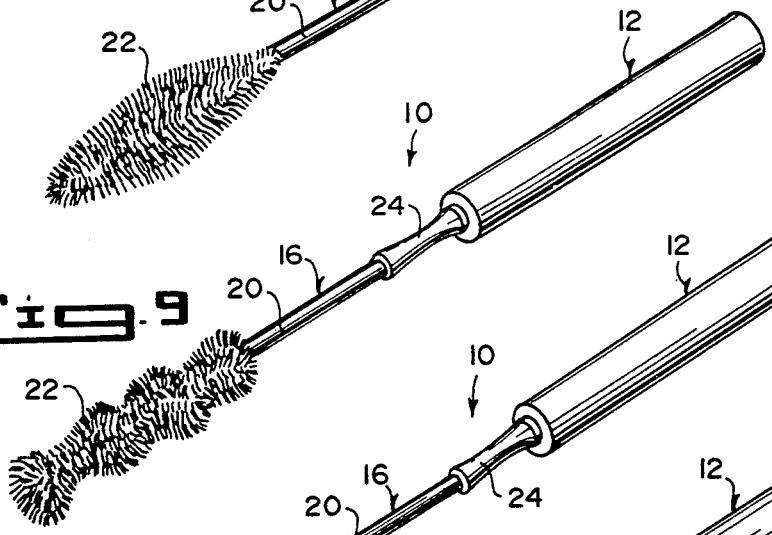
Fig. 9
Fig. 10
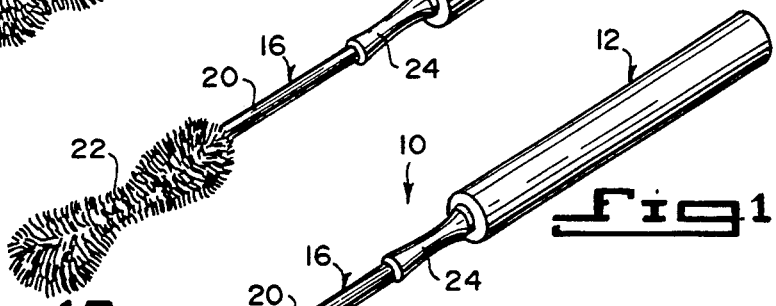
Fig. 11
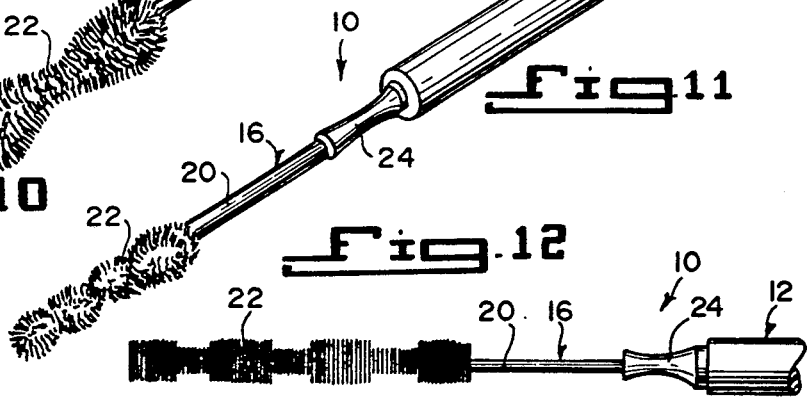
Fig. 12

ROTARY TOOTHBRUSH

BACKGROUND OF THE INVENTION

1. Field of the Invention

The instant invention relates generally to toothbrushes and more specifically it relates to an axis rotary toothbrush.

2. Description of the Prior Art

Numerous toothbrushes have been provided in prior art that are adapted to clean the teeth in a side to side horizontal motion or up and down vertical motion, whereby damage may occur to the gum line by vigorous horizontal and vertical brushing. While these units may be suitable for the particular purpose to which they address, they would not be as suitable for the purposes of the present invention as heretofore described.

SUMMARY OF THE INVENTION

A primary object of the present invention is to provide a an axis rotary toothbrush that will overcome the shortcomings of the prior art devices.

Another object is to provide an axis rotary toothbrush that contains a bristle head formed about the end of a rotatable shaft extending from a handle so as to clean the teeth by a rotary action.

An additional object is to provide an axis rotary toothbrush in which the rotatable shaft is manually operable in a clockwise or counterclockwise fashion by an index finger and a thumb of a hand that grasps the handle of the toothbrush in order to brush the teeth by the rotary action.

A further object is to provide an axis rotary toothbrush that is simple and easy to use.

A still further object is to provide an axis rotary toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 7 is a front perspective view of the invention being held and operated by the hand of a person.

FIG. 8 is a front perspective view of the invention with a convex bristle head.

FIG. 9 is a front perspective view of the invention with a wavy bristle head.

FIG. 10 is a front perspective view of the invention with a concave bristle head.

FIG. 11 is a front perspective view of the invention with a worm shaped bristle head.

FIG. 12 is a side view of the invention with an elongated alternating size bristle head and the handle broken away.

DETAILED DESCRIPTION OF THE PREFERRED EMBODIMENTS

Figure 1:
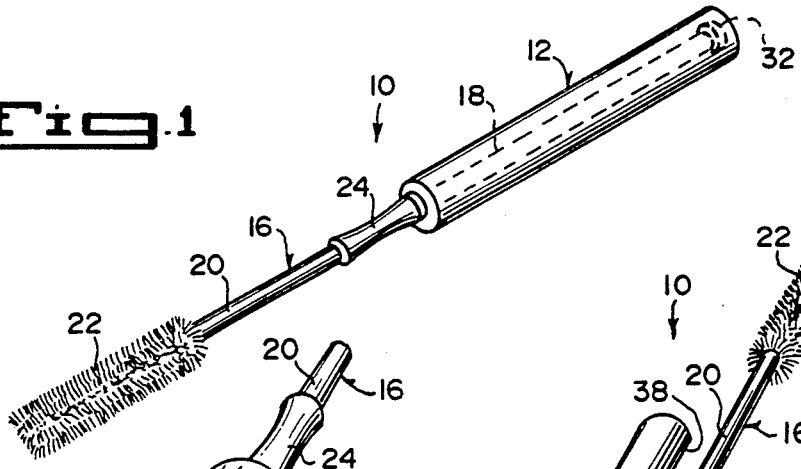
FIG. 1 is a front perspective view of the invention.
Figure 2:
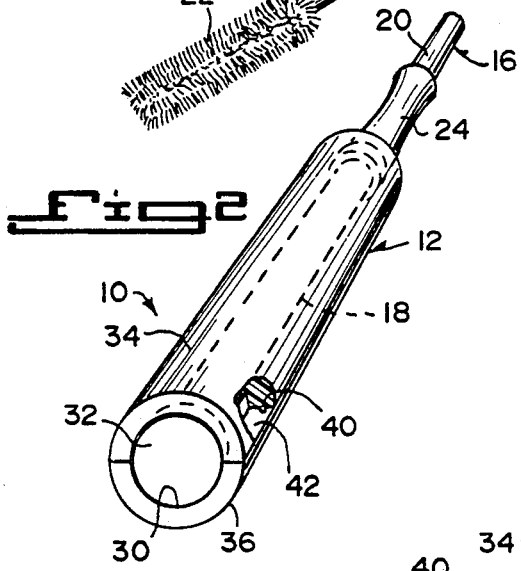
FIG. 2 is a rear perspective view with parts broken away and in section showing the back of the handle in greater detail.
Figure 3:
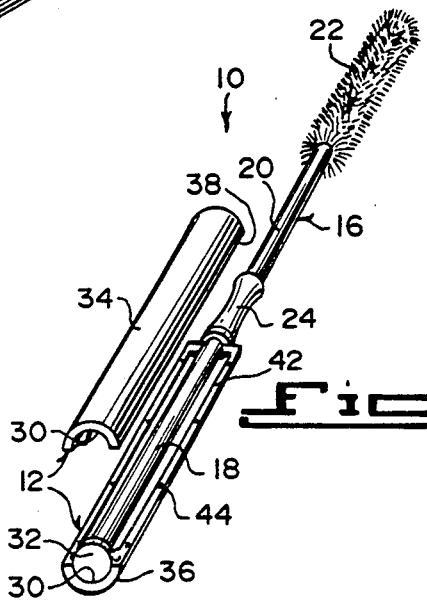
FIG. 3 is a rear perspective view showing one half of the longitudinally bisected handle separated therefrom.
Figure 4:
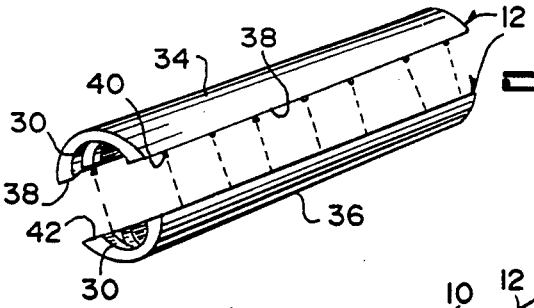
FIG. 4 is an exploded rear perspective view of the longitudinally bisected handle.
Figure 5:
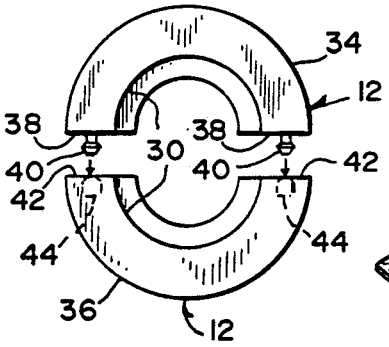
FIG. 5 is an exploded rear end view of the longitudinally bisected handle.

Turning now descriptively to the drawings, in which similar reference characters denote similar elements throughout the several views, the Figures illustrate an axis rotary toothbrush 10 consisting of a handle 12 to be grasped by the hand 14 of a person using the toothbrush 10. An elongated shaft 16 is rotatably positioned at its distal portion 18 within the handle 12 so that its proximal portion 20 extends outwardly therefrom. A bristle head 22 is formed about the free end of the proximal portion 20 of the shaft 16. A ferrule 24 is affixed onto the proximal portion 20 of the shaft 16 adjacent the handle 12. The index finger 26 and the thumb 28 of the hand 14 of the person gripping the handle 12 can manually rotate the ferrule 24 to turn the shaft 16 and the bristle head 22 in a clockwise and counterclockwise direction about the axis of the shaft 16 in order for the bristle head 22 to brush the teeth by a rotary action, pushing particles of foreign matter away from the gum line and the teeth, while at the same time stimulating the gum line.

The handle 12 is cylindrical, is fabricated out of durable plastic material and has an annular rear recess 30 therein. The shaft 16 is cylindrical, is fabricated out of durable plastic material and has an enlarged disc-shaped member 32 formed about the free end of the distal portion 18 thereof. The enlarged disc-shaped member 32 will rotatably ride within the annular rear recess 30 in the handle 12, while the ferrule 24 will rotatably ride on the proximal portion 20 of the shaft 16 adjacent the handle 12, thus rotatably capturing the distal portion 18 of the shaft 16 therebetween.

As best shown in FIGS. 2 through 5, the handle 12 can be longitudinally bisected into two halves 34 and 36 in which the mating edges 38 on the one half 34 of the handle 12 has a plurality of spaced apart male post couplers 40, while the mating edges 42 on the other half 36 of the handle 12 has a plurality of spaced apart female socket couplers 44 to receive the male post couplers 40 therein so that the distal portion 18 of the shaft 16 can be inserted and removed when needed.

Figure 6:
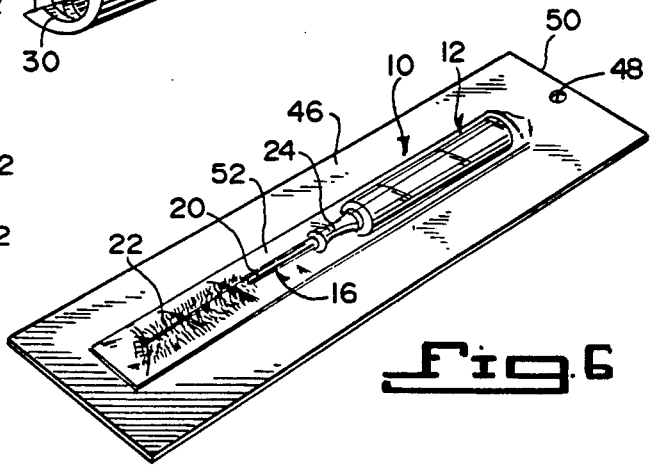
FIG. 6 is a front perspective view of the invention packaged in a blister card.

FIG. 6 shows a rectangular card 46 having a hole 48 at one short end 50 for hanging the card 46 therefrom. A clear see through blister 52 is affixed onto the card 46 for packaging the toothbrush 10 therein for marketing distribution.

The bristle head 22 shown in FIGS. 1, 3, 6 and 7 is of a standard uniform configuration. The bristle head 22 is FIG. 8 is a convex configuration, in FIG. 9 a wavy configuration, in FIG. 10 a concave configuration, in FIG. 11 a worm shaped configuration and in FIG. 12 an elongated alternating size configuration.

OPERATION OF THE TOOTHBRUSH 10

1. Upper teeth—left side.

A. While positioning the brush head 22 between the cheek and teeth, rotate the ferrule 24 in a clockwise motion.

B. While positioning the brush head 22 between the tongue and teeth, rotate the ferrule 24 in a counterclockwise motion.

2. Upper teeth—right side.

A. While positioning the brush head 22 between the cheek and teeth, rotate the ferrule 24 in a counterclockwise motion.

B. While positioning the brush head 22 between the tongue and teeth, rotate the ferrule 24 in a clockwise motion.

3. Lower teeth—left side.

A. While positioning the brush head 22 between the cheek and teeth, rotate the ferrule 24 in a counterclockwise motion.

B. While positioning the brush head 22 between the tongue and teeth, rotate the ferrule 24 in a clockwise motion.

4. Lower teeth—right side.

A. While positioning the brush head 22 between the cheek and teeth, rotate the ferrule 24 in a clockwise motion.

B. While positioning the brush head 22 between the tongue and teeth, rotate the ferrule 24 in a counterclockwise motion.

The toothbrush 10 could be used in a conventional manner without rotating the ferrule 24 by simply grasping the handle 12 firmly and brushing.

LIST OF REFERENCE NUMBERS

10: axis rotary toothbrush
12: handle
14: hand
16: elongated shaft
18: distal portion of 16
20: proximal portion of 16
22: bristle head on 20
24: ferrule
26: index finger on 14
28: thumb on 14
30: annular rear recess in 12
32: enlarged disc-shaped member on 18
34: one half of 12
36: other half of 12
38: mating edge on 34
40: male post coupler on 38
42: mating edge on 36
44: female socket coupler on 42
46: rectangular card
48: hole in 46
50: short end of 46
52: clear see through blister.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A rotary toothbrush, comprising:

a) an elongated adapted handle to be grasped by the hand of a person using said toothbrush, said handle being longtudinally bisected into two halves in which the mating edges on one of said halves of said handle has a plurality of spaced apart male post couplers with resilient ballooning spherical free ends, while the mating edges on said other half of said handle has a plurality of spaced apart female socket couplers to receive said male post couplers therein so that a shaft can be inserted and removed when needed, said handle having an annular recess adjacent one end thereof;

b) an elongated shaft having a distal end portion and a proxial end portion rotatably positioned at its distal portion within said handle so that its proximal portion extends outwardly therefrom, said shaft is cylindrical, is fabricated out of durable plastic material and has an enlarged disc-shaped member formed about the end of the distal portion thereof so that said enlarged disc-shaped member will rotatably ride within said annular recess in said handle, said shaft being one homogeneous piece of material;

c) a ferrule affixed onto the proximal portion of said shaft adjacent said handle whereby said distal portion of said shaft is captured within said handle between said disc shape member and said ferrule so that the index finger and thumb of the hand of the person gripping said handle can manually rotate said ferrule to turn said shaft and said bristle head in a clockwise and counterclockwise direction about the axis of said shaft in order for said bristle head to brush the teeth by a rotary action, pushing particles of foreign matter away from the gum line and the teeth, while at the same time stimulating the gum line; and d) a bristle head formed about the free end of the proximal portion of said shaft, said bristle head being totally exposed and void of any covers or guard that could injure the user's mouth.

2. An axis rotary toothbrush as recited in claim 1, wherein said handle is cylindrical, is fabricated out of durable plastic material and has an annular rear recess therein.

3. An axis rotary toothbrush as recited in claim 1, further including:

a) a rectangular card having a hole at one short end for hanging said card therefrom; and b) a clear see through blister affixed onto said card for packaging said toothbrush therein for marketing distribution.

4. An axis rotary toothbrush as recited in claim 3, wherein said bristle head is of a cylindrical configuration about the free end of the proximal portion of said shaft.

5. An axis rotary toothbrush as recited in claim 3, wherein said bristle head is of a convex configuration about the free end of the proximal portion of said shaft.

6. An axis rotary toothbrush as recited in claim 3, wherein said bristle head is of a wavy configuration about the free end of the proximal portion of said shaft.

7. An axis rotary toothbrush as recited in claim 3, wherein said bristle head is of a concave configuration about the free end of the proximal portion of said shaft.

8. An axis rotary toothbrush as recited in claim 3, wherein said bristle head is of a worm shaped configuration about the free end of the proximal portion of said shaft.

9. An axis rotary toothbrush as recited in claim 3, wherein said bristle head is of an elongated alternating size configuration about the free end of the proximal portion of said shaft.

* * * * *